United States Patent [19]

Hardarson

[11] Patent Number: 4,629,245

[45] Date of Patent: Dec. 16, 1986

[54] FOLDING CHAIR

[76] Inventor: Valdimar Hardarson, Solheimar 27, 3 HD Reykjavik, Iceland

[21] Appl. No.: 621,065

[22] Filed: Jun. 15, 1984

[30] Foreign Application Priority Data

Jun. 15, 1983 [DE] Fed. Rep. of Germany ..... 3321585
Feb. 21, 1984 [DE] Fed. Rep. of Germany ..... 3406189

[51] Int. Cl.[4] ..... A47C 4/00

[52] U.S. Cl. ..... 297/16; 297/42; 297/46; 297/56

[58] Field of Search ..... 297/16, 34, 42, 44, 297/47, 52, 39, 46, 50, 56, 298, 314; 248/436

[56] References Cited

U.S. PATENT DOCUMENTS

| | | | |
|---|---|---|---|
| 102,180 | 4/1870 | Stewart | 297/56 |
| 628,584 | 7/1899 | Kutz et al. | 297/42 |
| 2,540,254 | 2/1951 | Garber . | |
| 2,613,730 | 10/1952 | Anderson et al. | 297/42 |
| 3,765,718 | 10/1973 | Chen | 297/298 X |
| 3,857,604 | 12/1974 | Scott | 297/16 |
| 4,108,490 | 8/1978 | Marin . | |

FOREIGN PATENT DOCUMENTS

| | | | |
|---|---|---|---|
| 120377 | 9/1945 | Australia | 297/46 |
| 1748769 | 7/1957 | Fed. Rep. of Germany . | |
| 6910497 | 3/1969 | Fed. Rep. of Germany . | |
| 1529423 | 2/1970 | Fed. Rep. of Germany . | |
| 320878 | 12/1902 | France | 297/46 |
| 226891 | 5/1943 | Switzerland | 297/42 |

*Primary Examiner*—William E. Lyddane
*Assistant Examiner*—Laurie K. Cranmer
*Attorney, Agent, or Firm*—Young & Thompson

[57] ABSTRACT

The folding chair (1) comprises a rack (2) of two interlocking swivel frames (3, 4), which latter are connected centrally by means of joints. The two lateral frame sections (10, 11) of the outer swivel frame (3) and a lateral frame section (14) of the inner swivel frame (4) of the folding rack (2) comprise extensions (**10*a*, 11*a*, 14*a*) projecting upwardly past the seat panel (8). At the ends of the extensions (10*a*, 11*a*) of the frame sections (10, 11) of the outer swivel frame (3), a semiring-shaped back (17), adapted to the shape of the seat panel (8), is mounted to be pivotable into a horizontal (17') and a vertical end position. The end of the extension (14*a*) of the lateral frame section (14) of the inner swivel frame (4) is displaceably guided over a swivel angle of 90° by means of a slide element (21) in a circular-arc guide in or at the back (20**).

8 Claims, 15 Drawing Figures

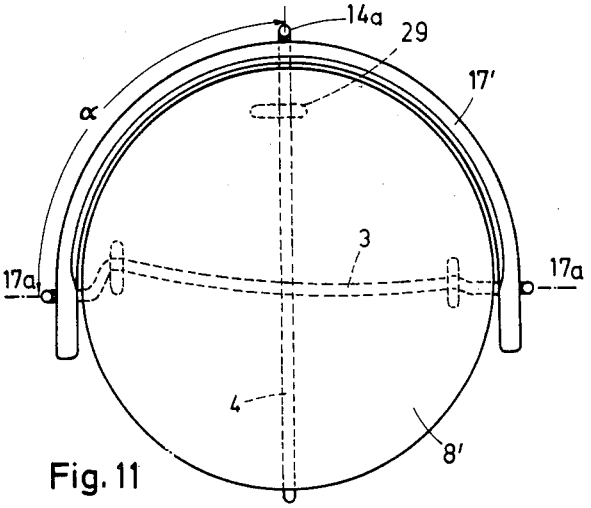
Fig. 11
Fig. 13
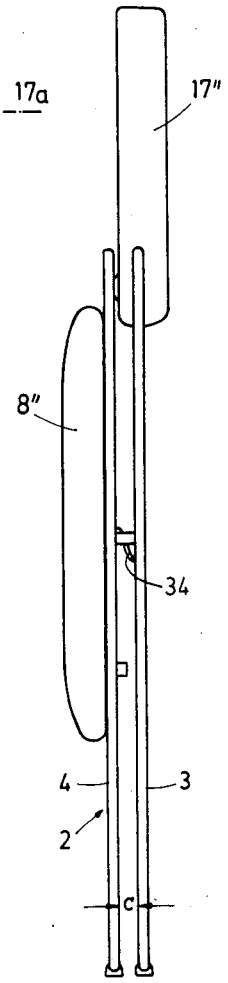
Fig. 14
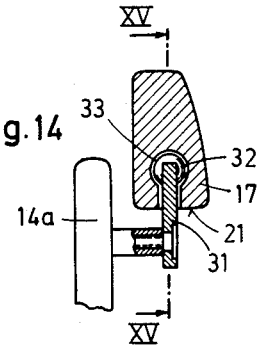
Fig. 15
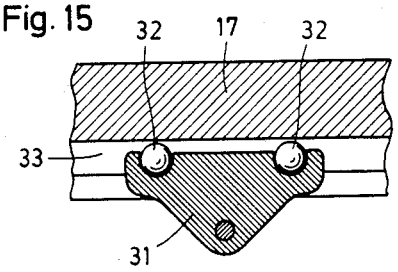

FOLDING CHAIR

Folding chairs of the type known from U.S. Pat. No. 4,108,490 are expensive in their construction, inconvenient in handling, and relatively bulky in the folded condition and thus difficult to store; the structural elements of the folding frames do not convey a pleasing total impression with respect to the configurational design.

The invention is based on the object of developing a folding chair distinguished by a simple structure and easy handling, as well as an elegant design.

This object has been attained according to the invention by the features described hereinafter.

Besides the advantages derivable from the posed objectives, the folding chair of this invention excels in that it can be folded into a very flat shape, can be hung up during nonuse in a space-saving fashion, possesses fewer individual parts than a customary folding chair with back and armrests on account of the one-piece design of the back and arm rests in the form of a semiring and/or bow and consequently can be manufactured with less expense, and offers pleasant seating comfort. Apart from private use, the folding chair is excellently suited for providing furnishing for rooms with various usage, for example for furnishing cafeterias, street cafes, or in museums.

The invention will be explained below in detail with reference to two embodiments shown in the drawings wherein.

Figure 1:
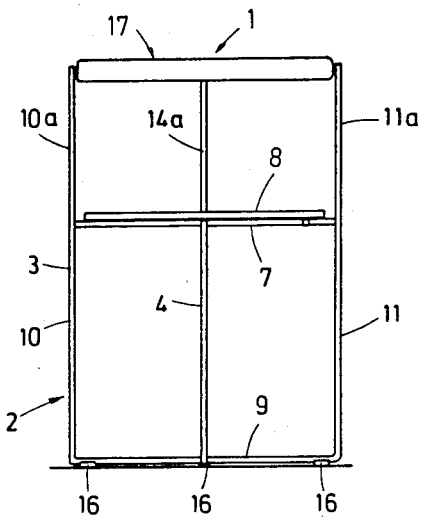
FIG. 1 is a frontal view of a first embodiment of the folding chair.
Figure 2:
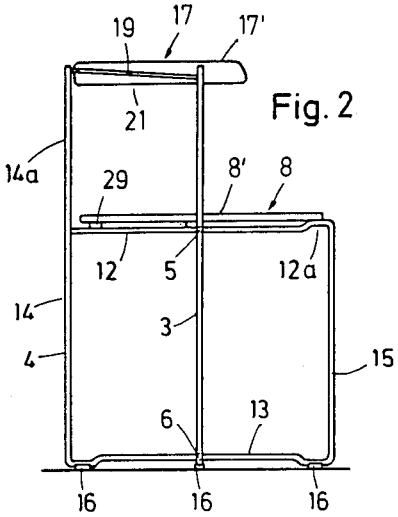
FIG. 2 is a lateral view of the chair.
Figure 3:
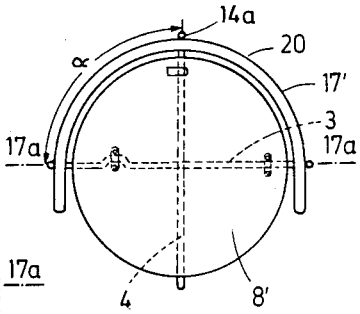
FIG. 3 is a top view of the chair according to FIGS. 1 and 2.
Figure 4:
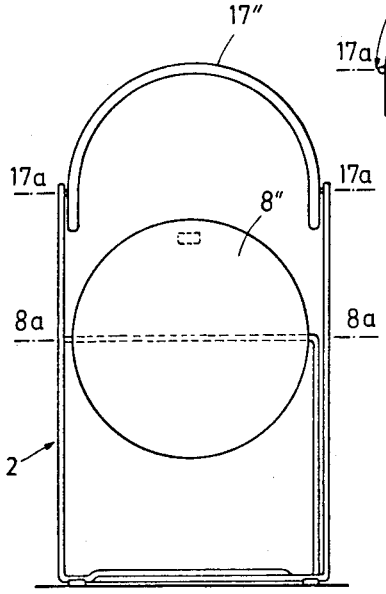
Figure 5:
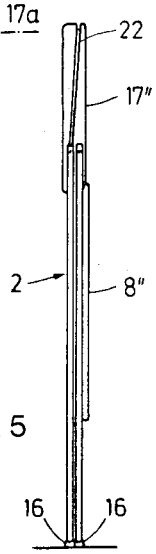
Figure 6:
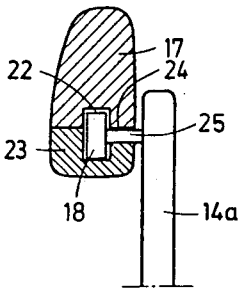
Figure 7:
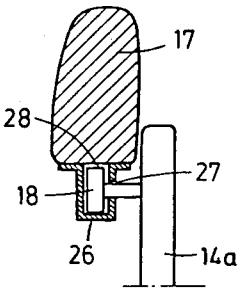
Figure 8:
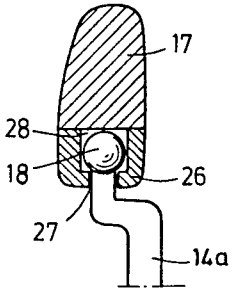
Figure 9:
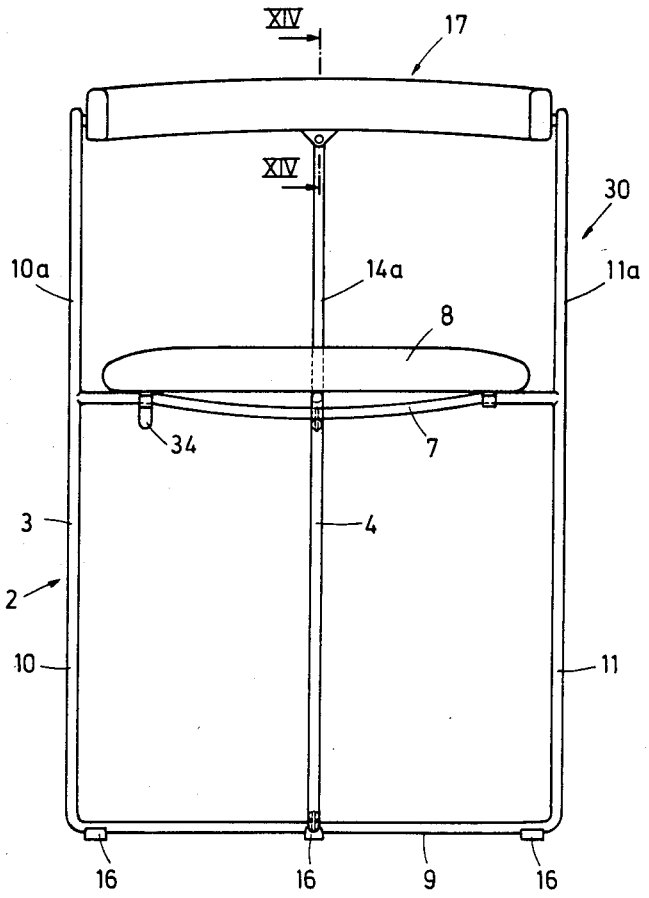
Figure 10:
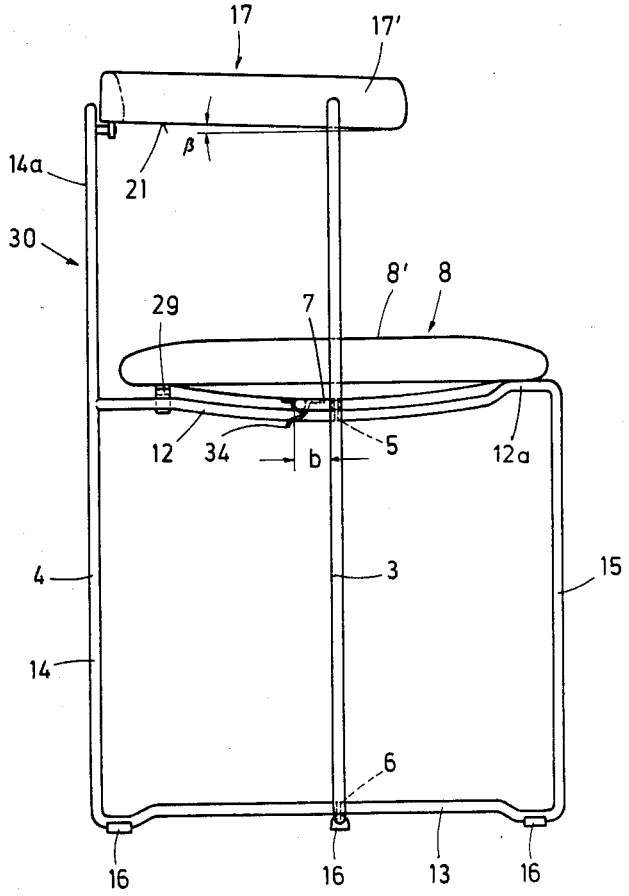
Figure 12:
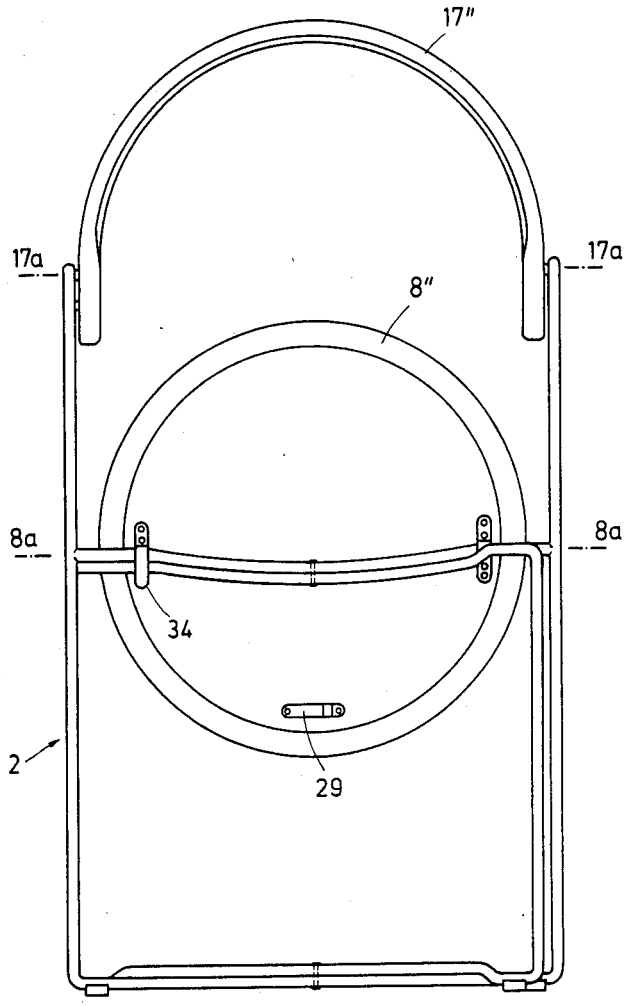

FIGS. 4 and 5 show respectively a rear view and a lateral view of the folded chair, FIGS. 6–8 show cross sections of three additional versions of the back of the chair, FIG. 9 shows a frontal view of a second embodiment of the folding chair, FIG. 10 is a lateral view of the chair of FIG. 9, FIG. 11 is a top view of the chair according to FIGS. 9 and 10, FIGS. 12 and 13 show respectively the frontal view and a lateral view of the folded chair, on an enlarged scale, FIG. 14 shows a section along line XIV—XIV of FIG. 9, and FIG. 15 is a section along line XV—XV of FIG. 14.

The same or similar components in the individual figures are characterized by identical reference numerals.

The framework 2 of the folding chair 1 according to FIGS. 1–5 comprises two interlocking, rectangular swivel frames 3, 4, joined centrally by joints 5, 6 with each other. The outer swivel frame 3 of the folding framework 2 consists of an upper supporting frame section 7 for a seat panel 8 of wood or plastic, furthermore of a lower frame section 9 and two lateral frame sections 10, 11 as the chair legs. The seat panel 8 is pivotably mounted to the upper frame section 7 and can be pivoted into the horizontal in-use position 8' and, for collapsing the chair 1, into the vertical position 8''.

The inner swivel frame 4 inserted in the outer swivel frame 3 consists, just as frame 3, of an upper supporting frame section 12 for the seat panel 8, a lower frame section 13, as well as two lateral frame sections 14, 15 forming chair legs. The upper and lower frame sections 12 and 13 of the inner swivel frame 4 are offset toward the inside by the frame thickness of the upper and lower frame section 7 or 9, respectively, of the outer swivel frame 3, so that the two frames 3, 4 fit into each other. Base blocks 16 of a synthetic resin are attached to the lower frame sections 9, 13 of the outer and inner swivel frames 3, 4, these blocks ensuring a non-skid stand of the chair 1.

The swivel frames 3, 4 of the folding framework 2 are made of chrome-plated rod or pipe material.

The two lateral frame sections 10, 11 of the outer swivel frame 3 and the lateral frame section 14 of the inner swivel frame 4 have extensions **10*a*, 11*a*, 14*a*, projecting upwardly past the circular seat panel 8. At the ends of the extensions 10*a*, 11*a* of the lateral frame sections 10, 11 of the outer swivel frame 3, a half-ring-shaped back 17 of wood or plastic, adapted to the shape of the seat panel 8, is supported to be pivotable into a horizontal in-use position 17' and into a vertical position 17'' upon collapsing of the chair 1, the pivot axes 8*a*—8*a* and 17*a*—17*a* of the seat panel 8 of the back 17 lying in the plane of the outer swivel framework 3 of rack 2**.

The end of the extension **14*a* of the lateral frame section 14 of the inner swivel frame 4 is guided displaceably over a swivel angle of 90° in a circular-arc guide in the back 17, by means of a slide element 18 which is fashioned as a pin, a screw head, a slide roller, or a slide ball. The circular-arc guide for the inner swivel frame 4 is constituted by a groove 19 which ascends helically on the outside 20 of the back 17 from one end of the back 17, mounted rotatably on the outer swivel frame 3, up to the center of the back. By this guidance of the inner swivel frame 4 on the back 17, the object is achieved that, the back 17, during collapsing of the chair 1, swivels substantially automatically, with a slight supporting manual movement, from the in-use position 17' into the vertical position 17''**.

In a modification of the above-described chair structure, the extension **14*a* of the lateral frame section 14 of the inner swivel frame 4 can be guided on the underside 21 of the back 17** in order to impart a more esthetic appearance to the chair.

According to FIG. 6, the end of the extension **14*a* is guided by means of a slide element 18 fashioned as a roller in a groove 22, which latter is, in part, formed in the underside 21 of the back 17 and, in part, is formed by a cover rail 23 of plastic or metal with a U-shaped profile, this rail exhibiting a passage slot 24 for the revolving shaft 25 of the slide roller 18**.

In two further embodiments of the back 17 according to FIGS. 7 and 8, a circular-arc-shaped guide rail 26 is mounted on the underside 21 of the back 17, this rail having a passage slot 27 and a groove 28 to guide the slide element 18 on the extension **14*a*, this slide element being designed in the embodiment of FIG. 7 as a roller and in the embodiment of FIG. 8** as a ball.

The seat panel 8, in the in-use position of the folding chair 1, is supported on the upper frame section 7 of the outer swivel frame 3 and on a crimped expansion **12*a* of the upper frame section 12 of the inner swivel frame, as well as on the frame section 12 by means of a clamping bracket 29 mounted on the underside of the seat panel, the bracket 29 arresting the swivel frames 3, 4 of the folding rack 2 in the in-use position of the chair and limiting the swivel angle $\alpha$ of the swivel frames 3, 4** to 90°.

The chair 1 can be placed into the in-use position and/or into the unused position by a simple unfolding and collapsing of the swivel frames 3, 4 of the folding rack 2, the seat panel 8 and the back 17 pivoting almost automatically into the horizontal position 8', 17' and into the vertical position 8'', 17''.

In the second embodiment of the folding chair 30 according to FIGS. 9–15, the lateral areas of the upper frame section 7 of the outer swivel frame 3, on which the seat panel 8 is pivotably mounted, project toward the rear from the plane of the frame, and the central zone of the frame section 7 is bent back into the frame plane. The upper frame sections 7, 12 of the outer and inner swivel frames 3, 4 are adapted to the downwardly curved seat panel 8, which latter is covered with a seat cushion.

The swivel axes 8*a*—8*a* and 17*a*—7*a* of the seat panel 8 and of the back 17 are offset with respect to each other in the horizontal direction by the dimension b of the upper frame section 7 of the outer swivel frame 3, which section projects toward the rear from the plane of the frame.

The end of the extension 14*a* of the lateral frame section 14 of the inner swivel frame 4 is displaceable in a circular arc over a swivel angle $\alpha$ of 90° in a guide groove 33 worked into the underside 21 of the back 17, by means of a guide fishplate 31 with two track balls 32, pivotably mounted on this extension. The back 17, in the in-use position of the folding chair, is supported by the extension 14*a* of the lateral frame section 14 of the inner swivel frame 4 in such a way that this back ascends slightly toward the rear from its swivel axis 17*a*–17*a* at an angle $\beta$. By this guidance of the inner swivel frame 4 on the back 17, the objective is attained that the back, during folding of the chair 30, swivels substantially automatically, with a slight supporting hand movement, from the horizontal in-use position 17' into the vertical unused position 17''. In this connection, the smoothly operating guidance of the inner swivel frame 4 by means of the fishplate 31 and the two track balls 32 in the back 17 provides a convenient mutual swiveling of the frames 3, 4.

On the underside of the seat panel 8, in the zone of its pivot axis 8*a*—8*a*, a fishplate 34 which is oriented toward the rear and obliquely downwardly is attached as a swivel aid for the upward folding of the seat panel into the unused position 8'', this fishplate cooperating, during collapsing of the chair 30, with the upper frame section 12 of the inner swivel frame 4.

In the collapsed condition of the chair 1, the guide fishplate 31 for the inner swivel frame 4, displaceable in the guide groove 33 in the back 17, provides a spacing between the two swivel frames 3, 4, with the aid of the fishplate 34 on the seat panel underside, by a certain dimension c, so that the user of the folding chair cannot pinch fingers between the swivel frames 3, 4.

I claim:

1. A folding chair comprising a framework of two flat frames each of which has a pair of vertically spaced substantially horizontal crosspieces interconnected at thier ends by uprights, one of said uprights of one said frame having an extension that extends a substantial distance above the upper said crosspiece of said one frame, both of said uprights of said other frame having extensions that extend upwardly a substantial distance above said upper crosspiece of said other frame, said frames being interconnected at midportions of their crosspieces for swinging movement relative to each other about a vertical axis, a seat panel mounted for vertical swinging movement on one of said upper crosspieces and adapted to overly and rest on and be supported in a substantially horizontal position on the other of said crosspieces when said frames are swung to a position in which said extension of said one frame is equally spaced from said extensions of said other frame, and a back pivotally attached to upper ends of said extensions of said other frame for vertical swinging movement about a horizontal axis between an upper position in which said back lies in the plane of said other frame and a lowered use position in which said back is substantially horizontal, the back having thereon a circular-arc guide that slidably receives a slide element on the upper end of said extension of said one frame whereby said slide element is guided over a swivel angle of about 90° about said vertical axis during pivotal movement of said frames and back relative to each other.

2. A folding chair according to claim 1, wherein said axes lie in the plane of said other frame.

3. A folding chair according to claim 1, wherein the extension (14*a*) of said one frame (4) is guided by the slide element (18) in a guide groove (19, 22, 28) at the bottom side (20, 21) of the back (17), the guide groove (19, 22, 28) ascending helically from an end of the back (17) pivotably supported by said other frame up to the middle of the back.

4. A folding chair according to claim 1, wherein the circular guide is a groove (22) which is formed in part in the underside (21) of the back (17) and in part by a U-shaped cover rail (23) adapted to the form of the back (17) and mounted on the underside of the back, the rail having a passage slot (24) for a shaft (25) extending from the slide element (18).

5. A folding chair according to claim 1, wherein the circular-arc guide is formed by a guide rail (26), mounted on the underside (21) of the back (17), with a passage slot (27) and a guide groove (28).

6. A folding chair according to claim 1, wherein the back (17), in the in-use position of the chair, slightly ascends toward the rear of the back from said horizontal axis (17*a*—*17a*), and the end of the extension (14*a*) of said one frame (4) is displaceable in a guide groove (33) formed in the underside (21) of the back (17) by means of a guide fishplate (31) with two track balls (32), said guide fishplate (31) being pivotably attached to said extension (14*a*) of said one frame (4).

7. A folding chair according to claim 6, wherein said upper crosspiece (7) of said other frame (3) projects toward the rear of the chair away from the plane of said frame in which are disposed said vertical and horizontal axes, and, on the underside of the seat (8), in the zone of said axis (8*a*—8*a*) of vertical swinging thereof, a pivot fishplate (34) is oriented rearwardly and obliquely downwardly to aid in the upward folding of the seat (8) into the unused position (8''), this pivot fishplate (34) cooperating, during collapsing of the chair (1), with the upper crosspiece (12) of said one frame (4).

8. A folding chair according to claim 1, and a bracket (29) attached to the underside of the seat for clamping the frames in the in-use position of the chair.

* * * * *